US006737849B2

(12) United States Patent
Eshraghi et al.

(10) Patent No.: US 6,737,849 B2
(45) Date of Patent: May 18, 2004

(54) CONSTANT CURRENT SOURCE HAVING A CONTROLLED TEMPERATURE COEFFICIENT

(75) Inventors: Aria Eshraghi, Woburn, MA (US); Xiaodong Wang, Acton, MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/173,628

(22) Filed: Jun. 19, 2002

(65) Prior Publication Data

US 2003/0234638 A1 Dec. 25, 2003

(51) Int. Cl.[7] ..... G05F 3/16
(52) U.S. Cl. ..... 323/315; 323/313; 323/907
(58) Field of Search ..... 323/312, 313, 323/314, 315, 901, 907

(56) References Cited

U.S. PATENT DOCUMENTS

| | | | | | |
|---|---|---|---|---|---|
| 4,110,677 | A | | 8/1978 | Boronkay et al. | |
| 4,339,707 | A | | 7/1982 | Gorecki | 323/313 |
| 4,399,399 | A | * | 8/1983 | Joseph | 323/315 |
| 4,553,083 | A | | 11/1985 | Yang | 323/313 |
| 4,769,589 | A | * | 9/1988 | Rosenthal | 323/313 |
| 4,792,748 | A | * | 12/1988 | Thomas et al. | 323/907 |
| 4,837,496 | A | * | 6/1989 | Erdi | 323/315 |
| 4,857,823 | A | | 8/1989 | Bitting | 323/314 |
| 4,890,052 | A | * | 12/1989 | Hellums | 323/312 |
| 5,103,159 | A | | 4/1992 | Breugnot et al. | 323/315 |
| 5,144,223 | A | * | 9/1992 | Gillingham | 323/313 |
| 5,173,656 | A | * | 12/1992 | Seevinck et al. | 323/316 |
| 5,440,224 | A | * | 8/1995 | Kimura | 323/315 |
| 5,497,073 | A | | 3/1996 | Böhme et al. | 323/312 |
| 5,517,103 | A | * | 5/1996 | Ng et al. | 323/901 |
| 5,521,489 | A | | 5/1996 | Fukami | 323/313 |
| 5,629,611 | A | | 5/1997 | McIntyre | 323/313 |
| 5,631,551 | A | * | 5/1997 | Scaccianoce et al. | 323/313 |
| 5,694,032 | A | | 12/1997 | Gersbach et al. | 323/315 |
| 5,726,563 | A | * | 3/1998 | Bolton | 323/313 |
| 6,002,242 | A | * | 12/1999 | Migliavacca | 323/314 |
| 6,002,245 | A | * | 12/1999 | Sauer | 323/315 |
| 6,201,435 | B1 | * | 3/2001 | Chou | 323/315 |
| 6,335,615 | B1 | | 1/2002 | Gorin | 323/317 |

* cited by examiner

*Primary Examiner*—Jeffrey Sterrett
(74) *Attorney, Agent, or Firm*—Connolly, Bove, Lodge & Hutz LLP

(57) ABSTRACT

A bandgap circuit for producing a constant current having a controllable temperature coefficient. A current mirror supplies first and second substantially identical currents to first and second bipolar transistors. A first resistor is connected across the emitters of the bipolar transistors. A second resistor connects one to the bipolar emitters to a common terminal where the current source currents are recombined and supplied to a common terminal of a power supply. The band gap voltage produced at the common base connections of the bipolar transistors have a voltage temperature coefficient which is controlled by the values of the resistors. A current source is coupled to receive the bandgap voltage and produces a current having a temperature coefficient corresponding to the voltage temperature coefficient of the bandgap voltage.

12 Claims, 1 Drawing Sheet

CONSTANT CURRENT SOURCE HAVING A CONTROLLED TEMPERATURE COEFFICIENT

BACKGROUND OF INVENTION

The present invention relates to a constant current source for use in radio frequency circuits. Specifically, a current source having a controllable temperature coefficient is described.

Radio frequency circuit applications for the cellular telephone field may require circuits which can operate over a wide temperature range. In the case of a transmitter circuit for a radio telephone, it is desirable to maintain a power output characteristic constant so that the compression point is stable with temperature. However, temperature changes typically decrease the gain or transconductance of active devices in the circuit, even when current is maintained constant over temperature. The loss in gain will decrease the compression point for an amplifier biased to operate in a class A mode of operation. As the compression point decreases, increased input signal levels do not increase the output signal level proportionally. It may be desirable in some applications to increase the bias current supplied to the amplifier to offset the loss in transconductance using a current source with a controllable temperature coefficient. A current source having a small positive temperature coefficient makes it possible to maintain the device gain and improve the overall stability of the RF circuit gain, noise figure and power output over an operating temperature range.

SUMMARY OF THE INVENTION

In accordance with the invention, a current source is provided which has a temperature coefficient which can be invariant with respect to temperature, or which may provide some small selectable temperature coefficient to offset component degradation with temperature. The invention generates a bandgap voltage which is coupled to a current source. The temperature coefficient of the bandgap voltage is selected by the value of a first resistor and the value of a second resistor of the bandgap generator. The bandgap voltage applied to the current source substantially determines the level of current produced by the current source. By controlling the relative resistance values, the temperature coefficient for the current source is also established.

DESCRIPTION OF THE FIGURES

The FIGURE in the application illustrates a current source having a controllable temperature coefficient in accordance with a preferred embodiment of the invention.

DESCRIPTION OF PREFERRED EMBODIMENTS

Figure 1:
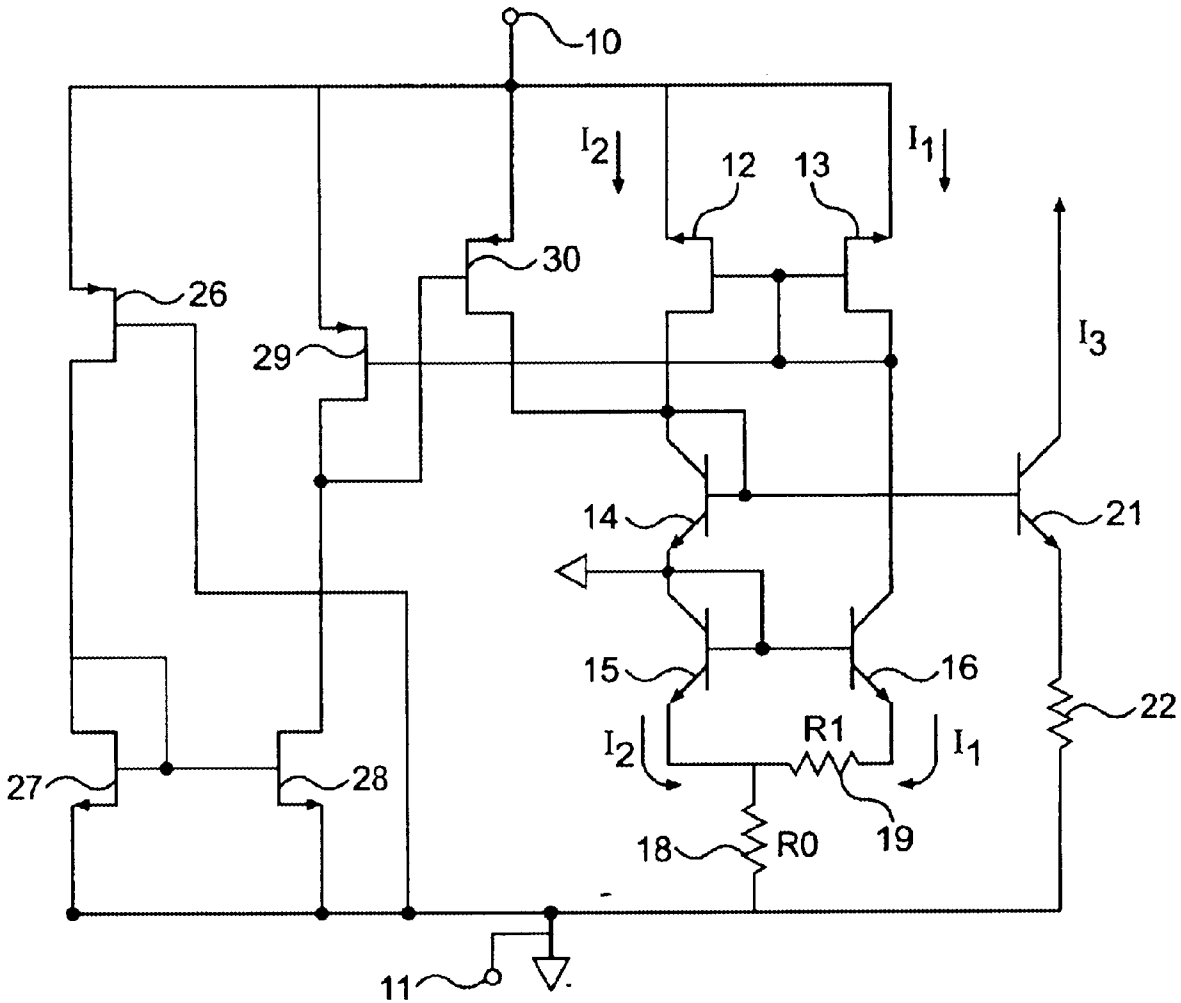

The schematic circuit drawing of the FIGURE illustrates a bandgap voltage generator connected to a current source. The bandgap voltage generator comprises a pair of bipolar transistors 15 and 16 fed from a current mirror comprising a PFET 12 and PFET 13. The current mirror produces first and second identical currents $I_1$ and $I_2$. $I_1$ is supplied to the collector connection of NPN bipolar transistor 16, and $I_2$ is supplied through a bipolar NPN transistor 14 to the collector connection of NPN bipolar transistor 15 of the bandgap voltage generator. Resistor 19 having a resistance value $R_1$ is connected across the emitter connection of NPN bipolar transistors 15 and 16, and resistor 18 having resistance value $R_0$ receives currents $I_1$ and $I_2$ and is connected to the common terminal 11 of the circuit. A power supply voltage is connected across terminal 10 and 11 to provide operating current for the device. The bandgap voltage generated at the base connection of NPN bipolar transistors 15 and 16 follows the general formula of:

$$V_{Bg}=V_{BE}+K\Delta V_{BE}$$

where $$K=\left(\ln\frac{A_2}{A_1}\right)\frac{R_0}{R_1};$$

$A_2$, and $A_1$ being the area of the base-emitters junctions of transistor 15 and 16, respectively.

$\Delta V_{Be}\approx kT/q_{V_T}\approx VBE15-VBE16$, where VBE15 and VBE16 are the base emitter voltages of transistors 15 and 16.

$$\text{since } V_{BE1}=V_T l\frac{I_1}{A_1 I_2} \text{ and} \quad (1)$$

$$V_{BE2}=V_T l\frac{I_2}{A_2 I_1}, \text{ then } \Delta V_{BE}=V_T \ln\frac{A_2}{A_1}$$

The current through the collector emitter connection s is generally:

$$I=I_s AeV/V_T$$

Therefore, $$I_1=I_s A_{1e}{}^{VBE1/VT}$$

$$I_2=I_s A_2 e V^{BE2/V_T}$$

The bandgap voltage $V_{Bg}$ can be made substantially temperature invariant by selecting the values of resistors 19 and 18, $R_1$ and $R_0$, so that the bandgap voltage follows the formula, $$V_{Bg}=V_{BE1}+2I\cdot R_0 \quad (2)$$

$$=V_{BE}+2\cdot\frac{\Delta V_{BE}}{R1}\cdot R0$$

where I is the total current through both branches ($I_1$+$I_2$) of the bandgap voltage generator. Since the temperature coefficient for silicon has a known negative temperature coefficient of minus 2 MV/° C., the negative temperature coefficient is effectively compensated for by the term $2IR_0$, recognizing that the current I through one branch of the bandgap generator is:

$$I=\frac{\Delta V_{BE}}{R_1} \quad (3)$$

Accordingly, equation (2) becomes $$V_{Bg}=V_{BE}+2\frac{R_0}{R_1}\cdot\Delta V_{BE} \quad (4)$$

$\Delta V_{BE}$, is the difference between base emitter voltages of transistors 15 and 16, or $$\Delta V_{BE} = V_{BE1} - V_{BE2} \quad (5)$$

$$= V_T In \frac{A_2}{A_1}$$

Since $\Delta V_{BE}$ equals $$V_T \ln \frac{A_2}{A_1},$$

the bandgap voltage $V_{BG}$ can be represented by $$V_{BG} = V_{BE} + 2\frac{R_0}{R_1} \cdot In \frac{A_2}{A_1} \cdot \frac{KT}{q} \quad (6)$$

Since $V_{BE}$ will have a negative coefficient, the remaining terms of equation 6 can be adjusted by selecting the ratio of $R_0/R_1$ to provide a positive temperature coefficient to offset the negative coefficient of the base emitter voltage of NPN bipolar transistors 15 and 16.

The substantially temperature invariant bandgap voltage developed at the base of bipolar transistors 15 and 16 is coupled through bipolar transistor 14 to the input of a current source comprising bipolar transistor 21 and resistor 22. The value of resistor 22 establishes for a given bandgap voltage applied to the base of transistor 21 a bias current 13 for the RF circuits of the cellular telephone.

Bipolar transistor 14 is connected in a diode configuration (base to collector) in one of the current paths of the bandgap voltage generator. As the transistors 14 and 21 have substantially the same base emitter junction area $A_1$, $A_2$ and are of the same material, the voltage drops across the base emitter connections of transistors 14 and 21 essentially offset each other so that the voltage applied to resistor 22, shown as $V_{out}$, is essentially the bandgap voltage.

Control over the temperature coefficient of current $I_3$ can therefore be affected by selecting the values $R_1$, $R_0$ of resistors 19 and 18 so that they either provide for total compensation of the negative temperature coefficient of the bandgap generator, or to provide a slightly positive temperature coefficient which may be helpful for offsetting the effects of temperature on other circuits which operate from bias current $I_3$.

As is common in bandgap voltage generators, a start up circuit is provided to make certain the circuit wakes up when power is supplied and assumes a stable bandgap voltage producing state. It is possible that the current mirror comprising PFET 12 and PFET 13 may start in a zero current conduction mode. In order to force the bandgap voltage generator into operation in a stable state, a start up circuit is provided which injects current into the branch of the bandgap generator comprising PFET 12 and bipolar transistor 15.

If the bandgap voltage circuit has not reached a stable state, a PFET 30 will inject current into the branch comprising PFET 12 and bipolar transistor 15. In effect, transistor 29 operates as a comparator to determine whether or not the voltage level at the gate of PFETS 12 and 13 is sufficient to render PFET 29 non-conducting. PFET 29 is included in a current mirror comprising NFET 27 and NFET 28. The current mirror circuit of NFET 27, 28 is kept in a conduction mode by PFET 26. In operation, if the current mirror comprising PFET 12, 13 is producing current for maintaining the bandgap voltage, current is diverted by PFET 29 so that PFET 30 no longer injects current into the branch of the bandgap circuit comprising PFET 12 and bipolar transistor 15.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form or application disclosed herein. Also, it is intended that the appended claims be construed to include alternative embodiments.

What is claimed is:

1. A circuit for producing a current having a controllable temperature coefficient comprising:

a current minor circuit for supplying from a first terminal of a power supply first and second currents;

first and second bipolar transistors having collector connections which receive respective of said first and second currents from said current mirror, and having base connections connected to each other and to said first bipolar transistor collector connection;

a first resistor connecting said bipolar transistors emitter connections together;

a second resistor connecting one of said bipolar transistors emitter connections to a common terminal of said power supply, said resistors having a values of resistance selected to produce a bandgap voltage at said base connections having a positive temperature coefficient; and a current source connected to receive said bandgap voltage and produce a current having a positive temperature coefficient proportional to said bandgap voltage.

2. The circuit according to claim 1 further comprising a third bipolar transistor having collector and emitter connections serially connecting said first transistor collector with said current mirror, and having a base connection connected to said third transistor collector and to an input of said current source.

3. A bandgap circuit for producing a current having a controlled temperature coefficient comprising:

a first current mirror circuit, connected to a terminal of a voltage supply for producing first and second equal currents;

a start up circuit for establishing a start up condition for said first current mirror circuit;

a first transistor having a collector and base connected to receive said first current;

second and third transistors having common base connections, a collector of said second transistor connected to receive a current from an emitter of said first transistor, a collector of said third transistor being connected to receive the second current;

a first resistor connected at one end to an emitter of said third transistor;

a second resistor connected at one end to a second end of said first resistor and to an emitter of said second transistor, and connected at a second end to a common terminal of said supply voltage; said first and second resistors being selected to produce a bandgap voltage having a positive temperature coefficient proportional to the ratio of said first and second resistor values; and a current source connected to said first transistor base whereby a current is produced having a temperature coefficient proportional to said bandgap voltage temperature coefficient.

4. The bandgap circuit according to claim 3 wherein said current mirror circuit comprises:

first and second FET transistors having a commonly connected gates, commonly connected sources connected to said terminal of said voltage supply, said second FET transistor having a drain connection connected to said second FET transistor gate, said first and second FET transistor drain connections producing said first and second currents.

5. The bandgap circuit according to claim 4 wherein said gates and said first transistor drain are connected to said start up circuit.

6. The bandgap circuit according to claim 3 wherein said start up circuit comprises:

a second minor circuit having first and second current producing transistors having source connections connected to said common terminal;

a reference current transistor serially connected with said first current producing transistor and said voltage supply terminal;

a transistor serially connecting said mirror circuit second current producing transistor with said voltage supply terminal, and connected from a gate connection to said third transistor collector, and a transistor serially connected from said first transistor collector to said terminal of said power supply, and having a gate connected to said mirror circuit second current producing transistor.

7. The circuit according to claim 6 wherein said start up circuit current minor circuit:

first and second FET transistors have commonly connected gate connections and drain connections providing said first and second currents, and said second FET gate connection being connected to its drain connection.

8. The circuit according to claim 3 wherein said first current mirror circuit comprises first and second FET transistors having source connections connected to said terminal of said voltage supply, and having commonly connected gate connections; said that and second FET transistors having drain connections producing said first and second currents.

9. A current source having a controlled temperature coefficient comprising:

a bandgap circuit for generating a bandgap voltage having a controllable temperature coefficient from first and second currents, said bandgap circuit having first and second bipolar transistors with commonly connected bases connected to said second bipolar transistor collector, said first translator having an first emitter resistor connected to an emitter of said second transistor, a second resistor connected to said second transistor emitter and to a common terminal for combining said first and second currents, said emitter resistor and said second resistor having values which define a positive temperature coefficient for said bandgap voltage; and a current source having an input terminal connected to receive said bandgap voltage for producing a current having a positive temperature coefficient proportional to said bandgap voltage.

10. The current source according to claim 9 wherein said bandgap circuit further comprises a transistor connected to couple said bandgap voltage to said current source input.

11. The current source according to claim 10 wherein said bandgap circuit includes a current mirror which supplies said first and second currents to said bipolar transistors, said first current being connected through said transistor which couples said bandgap voltage to said current source.

12. The current source according to claim 9 wherein said bandgap circuit includes a start up circuit for placing said bandgap circuit in a stable state.

* * * * *